US009033477B2

(12) United States Patent
Nishida

(10) Patent No.: US 9,033,477 B2
(45) Date of Patent: May 19, 2015

(54) PRINTER AND PRINT HEAD UNIT

(71) Applicant: BROTHER KOGYO KABUSHIKI KAISHA, Nagoya-shi (JP)

(72) Inventor: Katsunori Nishida, Aichi-gun (JP)

(73) Assignee: BROTHER KOGYO KABUSHIKI KAISHA, Nagoya-shi (JP)

( * ) Notice: Subject to any disclaimer, the term of this patent is extended or adjusted under 35 U.S.C. 154(b) by 0 days.

(21) Appl. No.: 14/464,239

(22) Filed: Aug. 20, 2014

(65) Prior Publication Data

US 2015/0091985 A1 Apr. 2, 2015

(30) Foreign Application Priority Data

Sep. 27, 2013 (JP) ..... 2013-200983

(51) Int. Cl.
*B41J 2/175* (2006.01)

(52) U.S. Cl.
CPC ..... *B41J 2/175* (2013.01)

(58) Field of Classification Search
CPC ..... B41J 2002/14362; B41J 2/14024; B41J 2002/14306; B41J 2002/14419; B41J 2/17523
USPC ..... 347/20, 45, 47, 54, 56, 84–86
See application file for complete search history.

(56) References Cited

U.S. PATENT DOCUMENTS

| | | | | |
|---|---|---|---|---|
| 7,168,795 | B2 * | 1/2007 | Shimizu | 347/84 |
| 8,511,808 | B2 * | 8/2013 | Yamaguchi et al. | 347/93 |
| 2005/0117000 | A1 | 6/2005 | Shimizu | |
| 2014/0240401 | A1 * | 8/2014 | Okubo | 347/47 |

FOREIGN PATENT DOCUMENTS

JP 2005-161571 A 6/2005

* cited by examiner

*Primary Examiner* — An Do
(74) *Attorney, Agent, or Firm* — Fox Rothschild LLP

(57) ABSTRACT

A printer includes an ejection portion, a liquid supply portion, a support member, a discharge portion, a first flow path portion, and an engagement portion. The ejection portion includes an ejection surface including a plurality of ejection ports. The liquid supply portion is configured to supply the ejection portion with liquid supplied from a storage portion. The liquid supply portion extends in parallel with the ejection surface. The support member is substantially box-shaped and includes a bottom wall portion and a side wall portion. The discharge portion is provided on the support member and is connected to an outside of the support member without going through the ejection portion. The first flow path portion includes a hollow portion and connects the liquid supply portion and the discharge portion. The engagement portion includes a recessed portion and is configured to fix the first flow path portion to the support member.

9 Claims, 8 Drawing Sheets

PRINTER AND PRINT HEAD UNIT

CROSS-REFERENCE TO RELATED APPLICATION

This application claims priority to Japanese Patent Application No. 2013-200983 filed Sep. 27, 2013, the content of which is hereby incorporated herein by reference.

BACKGROUND

The present disclosure relates to a printer that performs printing by ejecting liquid onto a print medium, and to a print head unit.

An inkjet printer performs printing on a print medium by ejecting ink from a nozzle. As this type of inkjet printer, an inkjet printer is known that includes with an inkjet head, a main tank and, a buffer tank. The main tank is an ink supply source and is disposed in the inkjet printer itself. The buffer tank is a liquid supply portion and connects the inkjet head and the main tank. In a case where ink is ejected from a plurality of nozzles of the inkjet head and is thereby consumed, ink is supplied from the main tank to the inkjet head via the buffer tank.

Air bubbles may enter into the buffer tank from the outside, due to air entering when the main tank is replaced, air permeability in an ink flow path system, etc. An inkjet printer includes a discharge flow path that is communicatively connected to the buffer tank without going through the inkjet head. A discharge pump is connected to the discharge flow path. The inkjet printer drives the discharge pump to suck and remove the ink in the ink supply path up to the buffer tank via the discharge flow path, together with the bubbles accumulated in the buffer tank, thus filling the buffer tank with ink. One end portion side of the buffer tank is fixed to the discharge flow path that extends in the up-down direction. Thus, the buffer tank is held in parallel with the direction in which a plurality of nozzles are arrayed on a nozzle surface.

SUMMARY

The above-described discharge flow path may be made of an elastic member. Another flow path or another member may be disposed below the buffer tank. In this case, as the discharge flow path becomes longer in the up-down direction, it may become difficult for the discharge flow path to support the buffer tank, which is the liquid supply portion, in parallel with the nozzle surface, due to the weight of the buffer tank and elastic deformation of the discharge flow path itself. A head unit, on which the inkjet head is mounted, includes various flow paths and other members in order to supply ink to the inkjet head. Therefore, there is a limitation on a space for disposing the buffer tank in the head unit. If the buffer tank is not held in parallel with the nozzle surface, there is a possibility of an increase in the size of the head unit.

Embodiments of the broad principles derived herein provide a printer that can support a liquid supply portion in parallel with an ejection surface on which a plurality of ejection ports are arrayed, and that makes it possible to downsize a print head unit, and a print head unit of the printer.

Embodiments provide a printer that includes an ejection portion, a liquid supply portion, a support member, a discharge portion, a first flow path portion, and an engagement portion. The ejection portion includes an ejection surface. The ejection surface includes a plurality of ejection ports arrayed along a direction intersecting an ejection direction. The plurality of ejection ports are configured to eject liquid in the ejection direction. The liquid supply portion is configured to supply the ejection portion with the liquid supplied from a storage portion. The storage portion is configured to store the liquid. The liquid supply portion extends in parallel with the ejection surface. The support member is substantially box-shaped and includes a bottom wall portion and a side wall portion. The side wall portion extends from a periphery of the bottom wall portion. The support member supports the ejection portion by fixing the ejection surface to the bottom wall portion. The discharge portion is provided on the support member. The discharge portion is connected to an outside of the support member without going through the ejection portion. The first flow path portion includes a hollow portion. The first flow path portion connects the liquid supply portion and the discharge portion. The first flow path portion is configured to support the liquid supply portion from below. The engagement portion includes a recessed portion. The engagement portion is configured to fix the first flow path portion to the support member by engaging with the side wall portion of the support member.

Embodiments also provide a print head unit that includes an ejection portion, a liquid supply portion, a support member, a discharge portion, a first flow path portion, and an engagement portion. The ejection portion includes an ejection surface. The ejection surface includes a plurality of ejection ports arrayed along a direction intersecting an ejection direction. The plurality of ejection ports are configured to eject liquid in the ejection direction. The liquid supply portion is configured to supply the ejection portion with the liquid. The liquid supply portion extends in parallel with the ejection surface. The support member is substantially box-shaped and includes a bottom wall portion and a side wall portion. The side wall portion extends from a periphery of the bottom wall portion. The support member supports the ejection portion by fixing the ejection surface to the bottom wall portion. The discharge portion is provided on the support member. The discharge portion is connected to an outside of the support member without going through the ejection portion. The first flow path portion includes a hollow portion. The first flow path portion connects the liquid supply portion and the discharge portion. The first flow path portion is configured to support the liquid supply portion from below. The engagement portion includes a recessed portion. The engagement portion is configured to fix the first flow path portion to the support member by engaging with the side wall portion of the support member.

BRIEF DESCRIPTION OF THE DRAWINGS

Embodiments will be described below in detail with reference to the accompanying drawings in which.

DETAILED DESCRIPTION

An embodiment will be explained with reference to the drawings. First, a schematic configuration of a printer 1 will be explained with reference to FIG. 1. The upper side, the lower side, the lower right side, the upper left side, the upper right side, and the lower left side of FIG. 1 respectively correspond to the upper side, the lower side, the front side, the rear side, the right side, and the left side of the printer 1.

Figure 1:
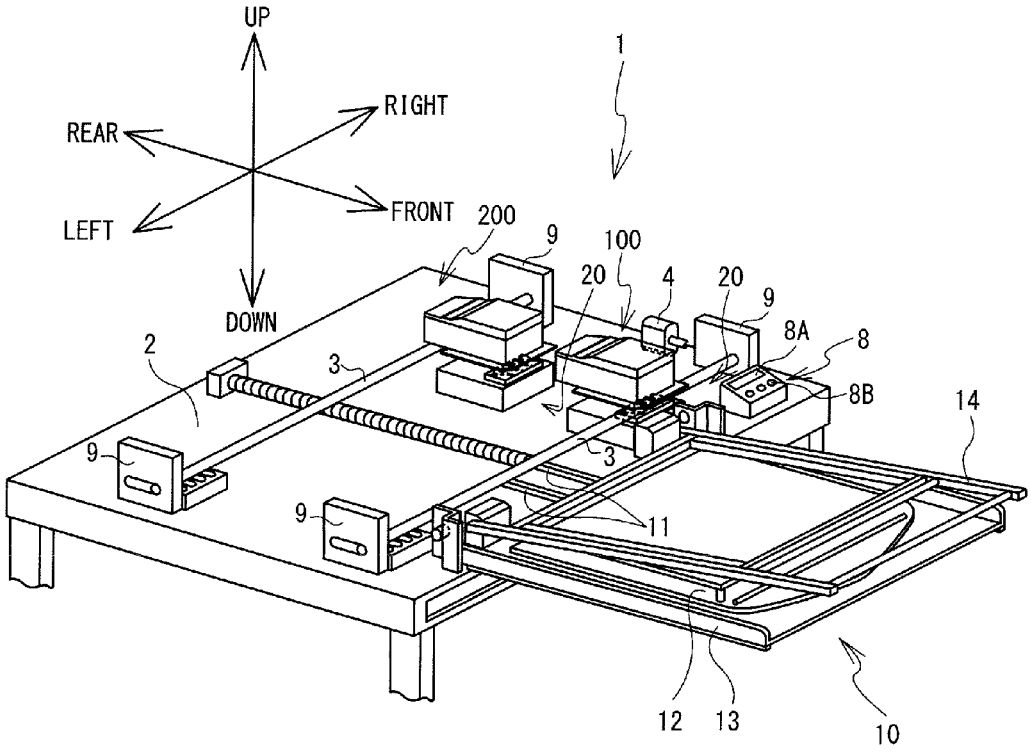
FIG. 1 is a perspective view of a printer.

As shown in FIG. 1, the printer 1 is an inkjet printer that performs printing by ejecting liquid ink onto a cloth (not shown in the drawings), such as a T shirt, which is a print medium. Paper or the like may be used as the print medium. In the present embodiment, the printer 1 can print a color image on the print medium by downwardly ejecting five types of ink (white (W), black (K), yellow (Y), cyan (C) and magenta (M) inks) that are different from each other. In the explanation below, of the five types of ink, the white color ink is referred to as a white ink, and the inks of the four colors of black, cyan, yellow, and magenta are collectively referred to as color ink. Further, in the explanation below, the direction in which the printer 1 ejects ink (the downward direction) is also referred to as a first direction, and an opposite direction (the upward direction) to the first direction is also referred to as a second direction.

The printer 1 mainly includes a base 2, a pair of guide rails 3, a drive motor 4, an operation portion 8, a platen device 10, two maintenance mechanisms 20 and head units 100 and 200. The base 2 is a flat plate-shaped base. The pair of guide rails 3 are shaft members that respectively extend above the base 2 in a direction (the left-right direction) that is orthogonal to the first direction. The pair of guide rails 3 are separated from each other in the front-rear direction. Wall portions 9 extend upwardly from the upper surface of the base 2. Both end portions of each of the pair of guide rails 3 are supported by the wall portions 9. The drive motor 4 is provided between the pair of guide rails 3 in the front-rear direction. The drive motor 4 can rotate in the forward direction and the reverse direction. The drive motor 4 is connected to the head units 100 and 200 via a drive mechanism (not shown in the drawings).

The operation portion 8 is provided on a front right portion of the upper surface of the base 2. The operation portion 8 includes a display 8A and operation buttons 8B. The display 8A may display various types of information. The operation buttons 8B may be used when a user inputs commands relating to various operations of the printer 1.

The platen device 10 is provided between the base 2 and the pair of guide rails 3 in the up-down direction. The platen device 10 includes a pair of guide rails 11, a platen 12, a tray 13, and a frame 14. The pair of guide rails 11 extend in the front-rear direction. The pair of guide rails 11 support the platen 12, the tray 13, and the frame 14 such that the pair of guide rails 11 can feed the platen 12, the tray 13, and the frame 14 in the front-rear direction. The platen 12 is a plate formed in a pentagonal shape in a plan view. The print medium may be placed on the upper surface of the platen 12. The platen 12 may be fed in the front-rear direction along the pair of guide rails 11 by a drive mechanism (not shown in the drawings) that is driven by a motor (not shown in the drawings). The tray 13 has a rectangular shape in a plan view, and is provided below the platen 12. The tray 13 may receive a sleeve or the like of a T-shirt that is placed on the platen 12, and thus may protect the sleeve or the like such that the sleeve or the like does not fall down onto the base 2 of the printer 1. The frame 14 is provided above the platen 12 and is formed in substantially the same shape as the outer peripheral edge of the tray 13. The frame 14 may fix the print medium to the platen 12.

The two maintenance mechanisms 20 are respectively provided below the right end portions of the pair of guide rails 3. The two maintenance mechanisms 20 are mechanisms to perform a purge of the head units 100 and 200, respectively. The purge is an operation that discharges ink containing foreign matter, bubbles, etc. from a head portion 120 and the like.

The structure of the head units 100 and 200 will be explained with reference to FIGS. 1 to 6. The head units 100 and 200 are provided side by side in the front-rear direction, and are connected by a connection member that is not shown in the drawings. The head unit 100 is positioned at the front side of the head unit 200. The head units 100 and 200 can be moved reciprocatingly above the base 2, via the drive mechanism, along the pair of guide rails 3 in the left-right direction, which is the feed direction (the direction of arrows X shown in FIG. 8). The head unit 100 can eject the color ink. The head unit 200 can eject the white ink.

In the present embodiment, before the color ink is ejected, the white ink may be ejected onto the whole or a part of an area, of the print medium, in which printing is performed. The white ink may be used as a base for printing, for example, in a case where the color of the print medium is dark. That is, the white ink may be a pre-treatment ink. After the white ink has been ejected onto the whole or a part of the area in which printing is performed, the color ink may be used to draw a pattern etc. in the area. That is, the color ink may be post-treatment inks. The white ink may also be used as a post-treatment ink to draw a pattern etc. Therefore, the printer 1 can perform various printing regardless of the color of the print medium.

Depending on a print image, the color inks for post-treatment need not necessarily be ejected after the white ink for pre-treatment has been ejected. More specifically, there may be an area onto which the white ink for pre-treatment only is ejected, or there may be an area onto which the color inks for post-treatment only are ejected. In the present embodiment, the white ink is used as the pre-treatment ink and the color ink are used as the post-treatment ink. However, the combination of the pre-treatment and post-treatment ink, the ink types, and the like can be changed as appropriate, and are not limited to the examples of the present embodiment.

The head unit 100 will be explained with reference to FIGS. 2 to 5. The illustration of ink tubes 19, which will be described below, is omitted in FIG. 5. The head unit 200 has the same structure as that of the head unit 100 except that the head unit 200 can eject the white ink instead of the color ink, and an explanation of the head unit 200 is thus omitted.

Figure 2:
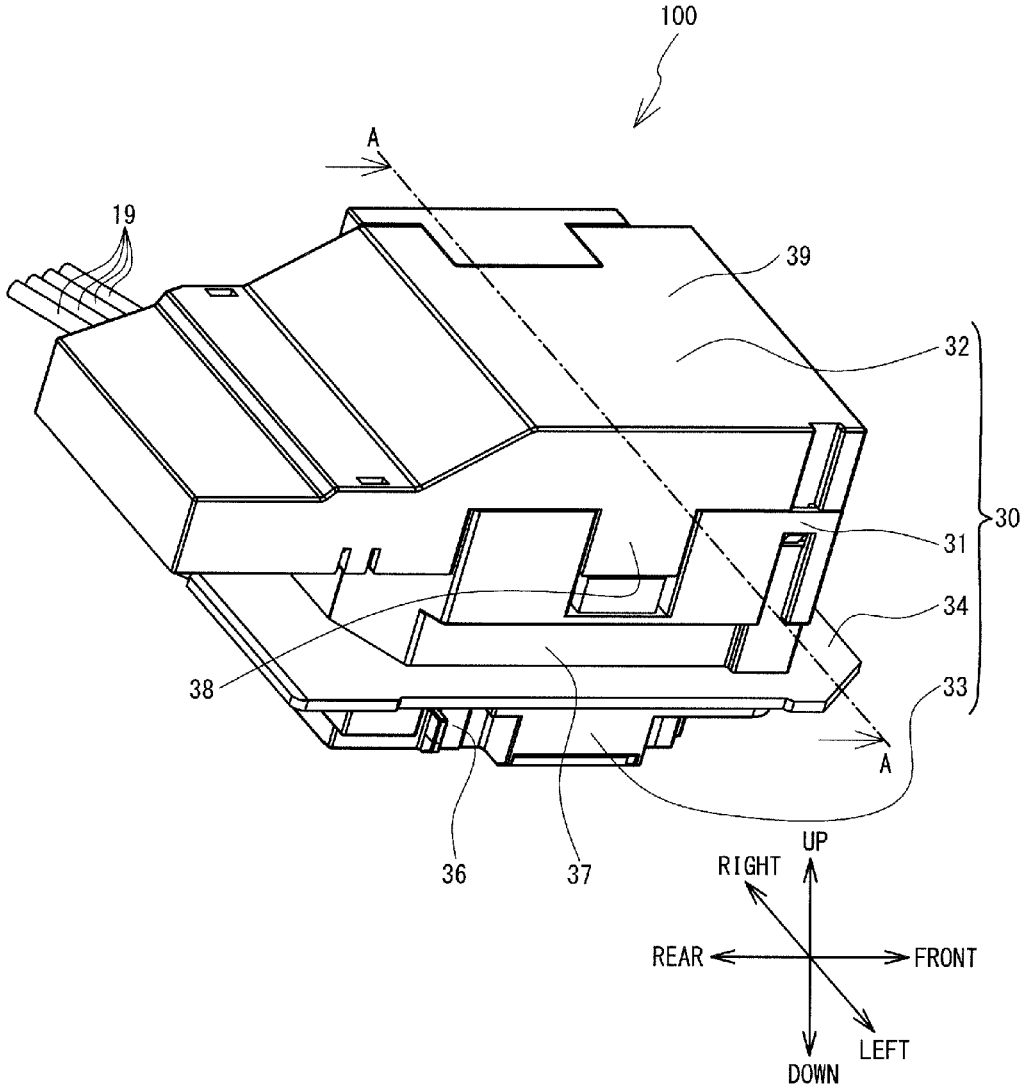
FIG. 2 is a perspective view of a head unit as viewed from the upper left side.
Figure 3:
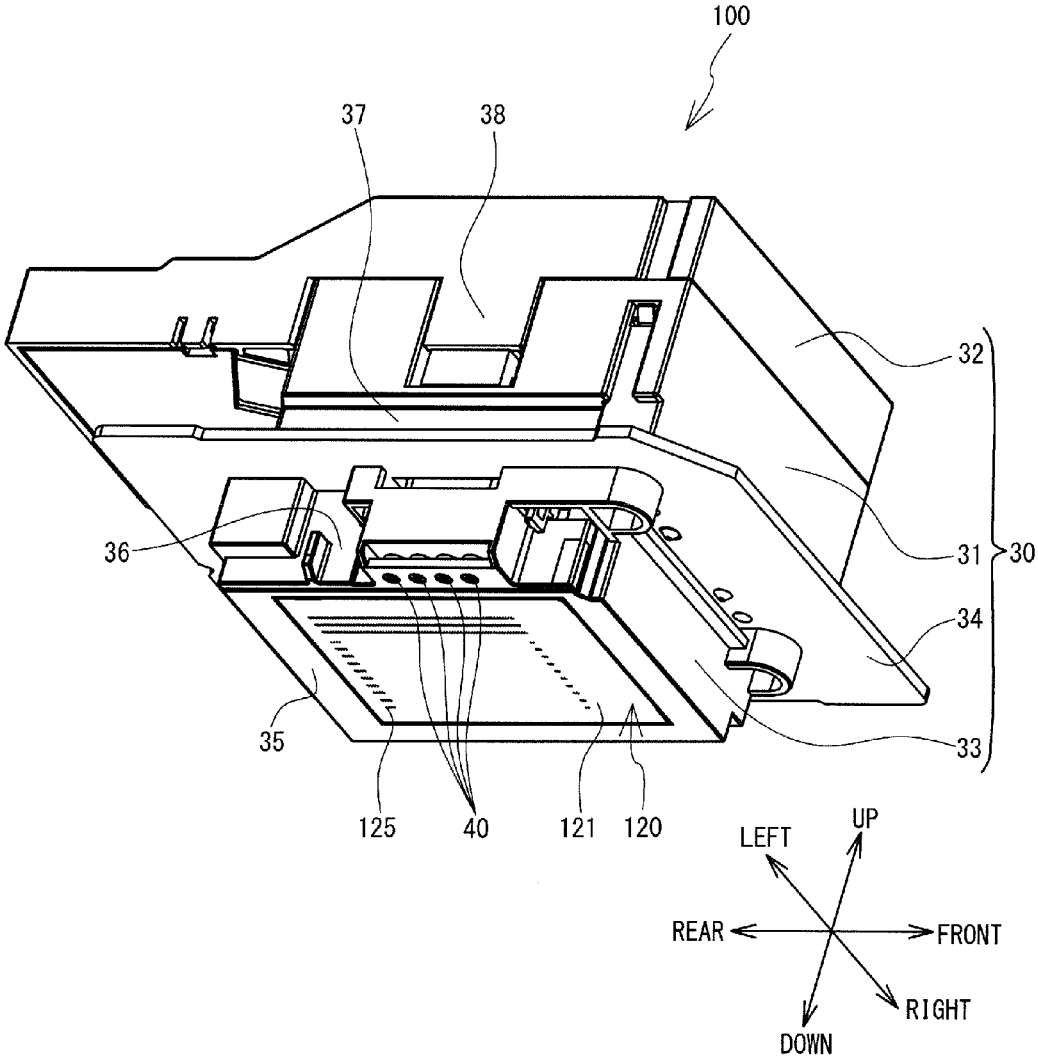
FIG. 3 is a perspective view of the head unit as viewed from the lower right side.

The head unit 100 includes a housing 30, the head portion 120, a buffer tank 60, a discharge portion 65, four supply flow path portions $0, a first heating portion 71, two boards 80, a second heating portion 72, and a heat dissipation portion 90. As shown in FIGS. 2 and 3, the housing 30 is a substantially box-shaped support member that supports the head portion 120. The housing 30 includes a support base 34, a first housing 31, a second housing 32, and a third housing 33. The support base 34 is a frame-shaped plate that has a rectangular shape in a plan view. A through hole (not shown in the drawings) is formed in a central portion of the support base 34. The first housing 31 has a substantially rectangular cylindrical shape and includes a first side wall portion 37, which extends upward from the support base 34. The first housing 31 is fixed to the upper surface of the support base 34, in a position where a cylindrical hole of the first housing 31 is connected to the through hole of the support base 34. The second housing 32 includes a top surface 39 and a second side wall portion 38. The second side wall portion 38 has a substantially rectangular cylindrical shape and extends downward from the top surface 39. The second housing 32 has a substantially box shape whose lower side is open. The second housing 32 covers the cylindrical hole of the first housing 31 from the upper side, which is an opposite side to an ejection surface 121 side, thus covering the buffer tank 60. The third housing 33 has a substantially box shape and includes a bottom surface 35 and a third side wall portion 36. The bottom surface 35 has an opening from which the ejection surface 121 is exposed in the first direction. The third side wall portion 36 has a substantially rectangular cylindrical shape and extends upward from the periphery of the bottom surface 35. The third housing 33 is fixed to the lower surface of the support base 34. A cylindrical hole of the third housing 33 is connected to the through hole of the support base 34 and the cylindrical hole of the first housing 31. More specifically, the first housing 31, the third housing 33, and the support base 34 are combined, and thus the first side wall portion 37 of the first housing 31 and the third side wall portion 36 of the third housing 33 are continuously provided such that the first side wall portion 37 and the third side wall portion 36 extend upward from the periphery of the bottom surface 35 of the third housing 33. The combined first housing 31 and the third housing 33 support the head portion 120 from the ejection surface 121 side. Four discharge pipes 40 are provided on a left end portion of the bottom surface 35 of the third housing 33. The four discharge pipes 40 will be described below.

As shown in FIG. 3, the head portion 120 has a substantially rectangular shape in a bottom view. The head portion 120 blocks the opening provided in the bottom surface 35 of the third housing 33. Although not shown in the drawings, the inside of the head portion 120 is divided into four sections along the left-right direction corresponding to the respective color inks. The planar ejection surface 121 that is parallel to the horizontal plane is formed on the bottom surface of the head portion 120. A plurality of very fine ejection ports 125 are provided in the ejection surface 121. Each of the plurality of ejection ports 125 can eject one of the color inks in the first direction. The plurality of ejection ports 125 that are arranged side by side in the front-rear direction form each of a plurality of rows that are arranged side by side in the left-right direction. More specifically, the plurality of ejection ports 125 are arrayed in the ejection surface 121 along the horizontal direction, which is a direction that intersects the first direction. A plurality of ejection channels (not shown in the drawings) and a plurality of piezoelectric elements (not shown in the drawings) are provided inside the head portion 120. The plurality of ejection ports 125 correspond to the plurality of ejection channels. When the plurality of piezoelectric elements (not shown in the drawings) are driven, through the plurality of ejection channels, the color inks can be ejected in the first direction from the ejection ports 125 that respectively correspond to the plurality of ejection channels.

Figure 4:
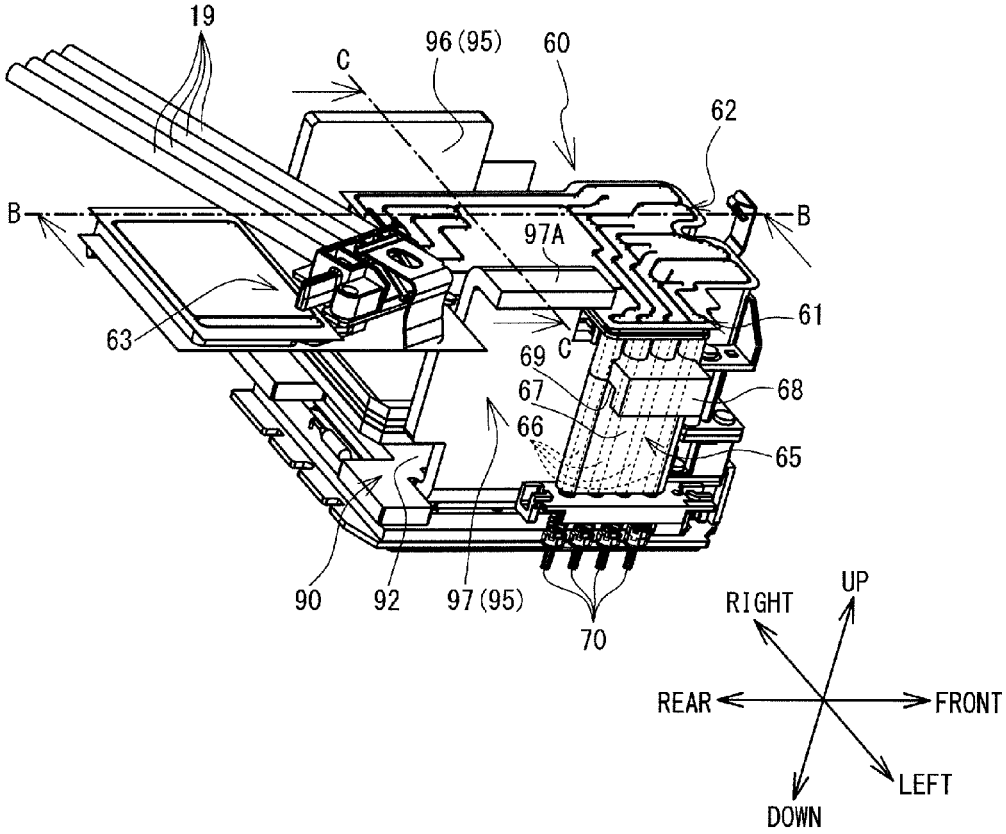
FIG. 4 is a perspective view of the inside of the head unit as viewed from the upper left side.

As shown in FIG. 4, the buffer tank 60 is disposed above the head portion 120, inside the head unit 100 (refer to FIG. 2), and extends in parallel with the ejection surface 121 (in the horizontal direction in the present embodiment). The buffer tank 604 has a substantially cuboid shape that is hollow. A joint 63 is attached to the rear portion of the upper surface of the buffer tank 60. The four ink tubes 19 are provided corresponding to the respective color inks. One end portions of the four ink tubes 19 are connected to the joint 63. The other end portions of the four ink tubes 19 are respectively connected to four main tanks 6 (refer to FIG. 7) that are disposed to the right of the base 2 (refer to FIG. 1). Through the four ink tubes 19, the color inks can be supplied from the main tanks 6 to the buffer tank 60. In order to supply the head portion 120 with the inks supplied from the ink tubes 19, the buffer tank 60 can store the inks for each of the colors. In other words, the buffer tank 60 can store the inks to be supplied to the head portion 120, between the main tanks 6 and the head portion 120 in a supply path of the liquid. Known cartridge-type ink tanks as well as flexible pouch-type ink packs made of resin, for example, can be used as the main tanks 6. Further, in addition to the buffer tank 60, a sub tank, such as a flexible pouch-type ink pack made of resin, may be provided between the main tanks 6 and the head portion 120.

The buffer tank 60 includes a first flow portion 61 and a second flow portion 62. The first flow portion 61 is provided on a left end portion of the buffer tank 60 and is connected to the discharge portion 65. The second flow portion 62 is provided on a front end portion of the buffer tank 60. The second flow portion 62 is connected to a vertical flow path portion 51 (refer to FIG. 5), and is configured to supply the color inks to the four supply flow path portions 50.

The discharge portion 65 has a substantially cuboid shape that extends downward from the first flow portion 61. The discharge portion 65 includes a main body portion 67 and an engagement portion 68. The main body portion 67 includes four discharge flow path portions 66. The engagement portion 68 is a hook-shaped protrusion that protrudes to the left from the main body portion 67. The lower side of the engagement portion 68 includes a recessed portion 69. The four discharge flow path portions 66 are hollow flow path portions that respectively pass through the discharge portion 65 in the up-down direction. The four discharge flow path portions 66 are provided side by side in the front-rear direction. The four discharge flow path portions 66 are provided for the respective color inks. Lower end portions of the four discharge flow path portions 66 are respectively connected to four discharge nozzles 70. The four discharge flow path portions 66 can discharge, among the color inks stored in the buffer tank 60, the ink that contains bubbles and flows out from the first flow portion 61, to the outside via the four discharge nozzles 70. The buffer tank 60 is configured to accumulate bubbles generated from the upstream main tank 6 side and to discharge the bubbles via the discharge portion 65. In a case where the head unit 100 is fed, dynamic pressure may be generated from the ink tubes 19, which is connected to the buffer tank 60. The buffer tank 60 is configured to absorb the dynamic pressure.

Figure 5:
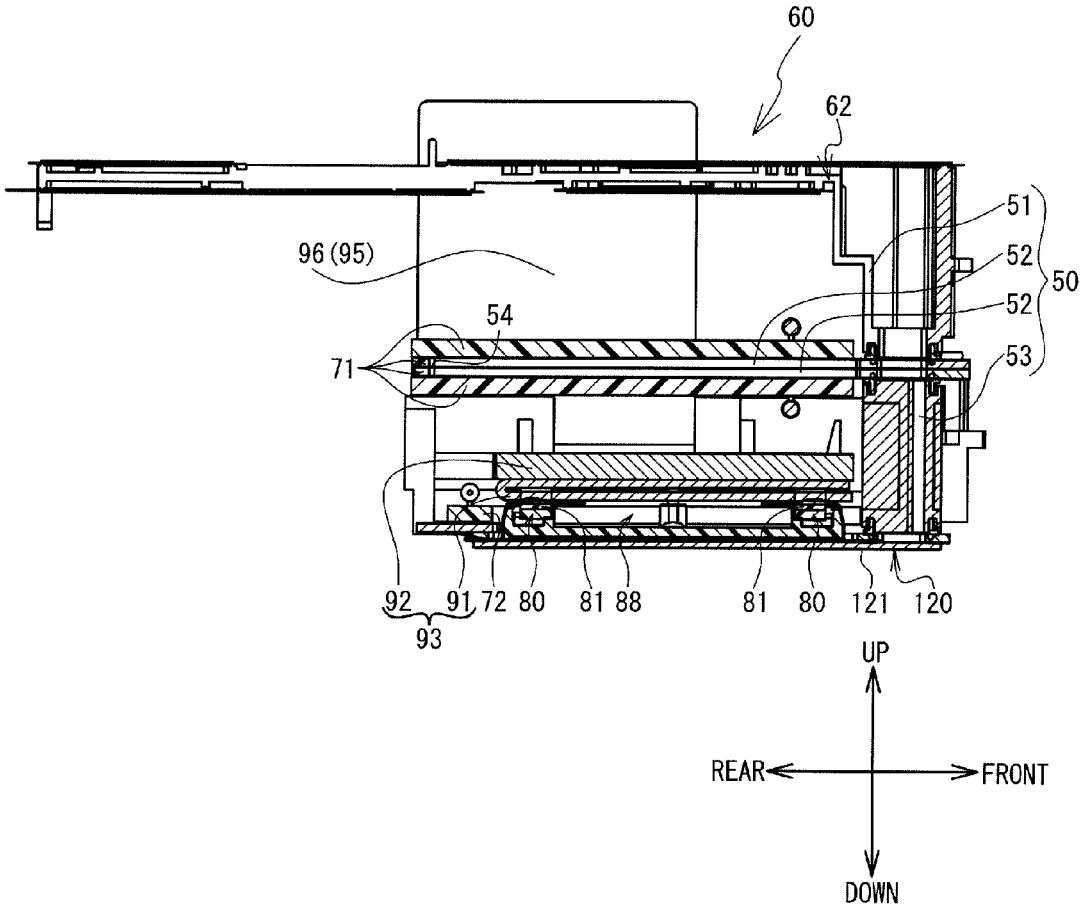
FIG. 5 is a cross-sectional view taken in the direction of arrows along a line B-B shown in FIG. 4.

As shown in FIG. 5, the four supply flow path portions 50 are hollow flow path portions that are configured to supply the head portion 120 with the color inks that flow out from the second flow portion 62. The four supply flow path portions 50 are provided between the buffer tank 60 and the head portion 120. The four supply flow path portions 50 are provided side by side in the left-right direction. The four supply flow path portions 50 are provided for the respective color inks. In the head unit 200, which may eject the white ink instead of the color inks, the white ink may be supplied to all the four supply flow path portions 50. Since the four supply flow path portions 50 have the same structure, only one of them will be explained below.

The supply flow path portion 50 includes the vertical flow path portion 51, a folded flow path portion 52, and a connection flow path portion 53. The vertical flow path portion 51 extends downward from the second flow portion 62 to substantially the center in the up-down direction between the buffer tank 60 and the head portion 120. The vertical flow path portion 51 is a flow path portion that extends in the up-down direction, which is a direction substantially orthogonal to the extending direction of the buffer tank 60. The lower end portion of the vertical flow path portion 51 is connected to one end portion of the folded flow path portion 52. The folded flow path portion 52 is a flow path portion that includes a flow path that extends to the rear along the front-rear direction from the lower end portion of the vertical flow path portion 51, a section 54 that is folded downward substantially above the rear end portion of the head portion 120, and a flow path that extends to the front along the front-rear direction from the section 54 to below the lower end portion of the vertical flow path portion 5. In other words, the folded flow path portion 52 is disposed away from the head portion 120. When viewed from the rear side, the cross section of the folded flow path portion 52 has a substantially rectangular shape that is long in the left-right direction (refer to FIG. 6). The connection flow path portion 53 is connected to the other end portion of the folded flow path portion 52 and to the head portion 120. The connection flow path portion 53 is a flow path portion that extends in the up-down direction, which is a direction substantially orthogonal to the extending direction of the buffer tank 60.

The first heating portion 71 will be explained. The first heating portion 71 is a sheet-shaped polyimide heater. The first heating portion 71 is provided along the folded flow path portion 52, on both the first direction side and the second direction side of the folded flow path portion 52. Further, the first heating portion 71 is positioned to the rear of the vertical flow path portion 51. The first heating portion 71 is configured to heat the color inks that flow through the four folded flow path portions 52 to a predetermined temperature. The predetermined temperature may be determined taking into account a usage environment of the printer 1, the ink type, the printing finish, and the like.

The two boards 80 are provided in positions that are separated from the folded flow path portion 52 in the first direction. The two boards 80 are separated from each other in the front-rear direction. Driving Integrated Circuits (ICs) 81 are respectively provided on the upper surfaces of the two boards 80. The two driving ICs 81 respectively supply electric power to the plurality of piezoelectric elements (not shown in the drawings) that are provided inside the head portion 120, and thus can control the ejection of the inks from the plurality of ejection ports 125 (refer to FIG. 3). The second heating portion 72 is a sheet-shaped polyimide heater. The second heating portion 72 is provided on the second direction side with respect to the head portion 120 and on the first direction side with respect to the two boards 80. The second heating portion 72 is configured to heat a peripheral portion of the ejection surface 121.

Figure 6:
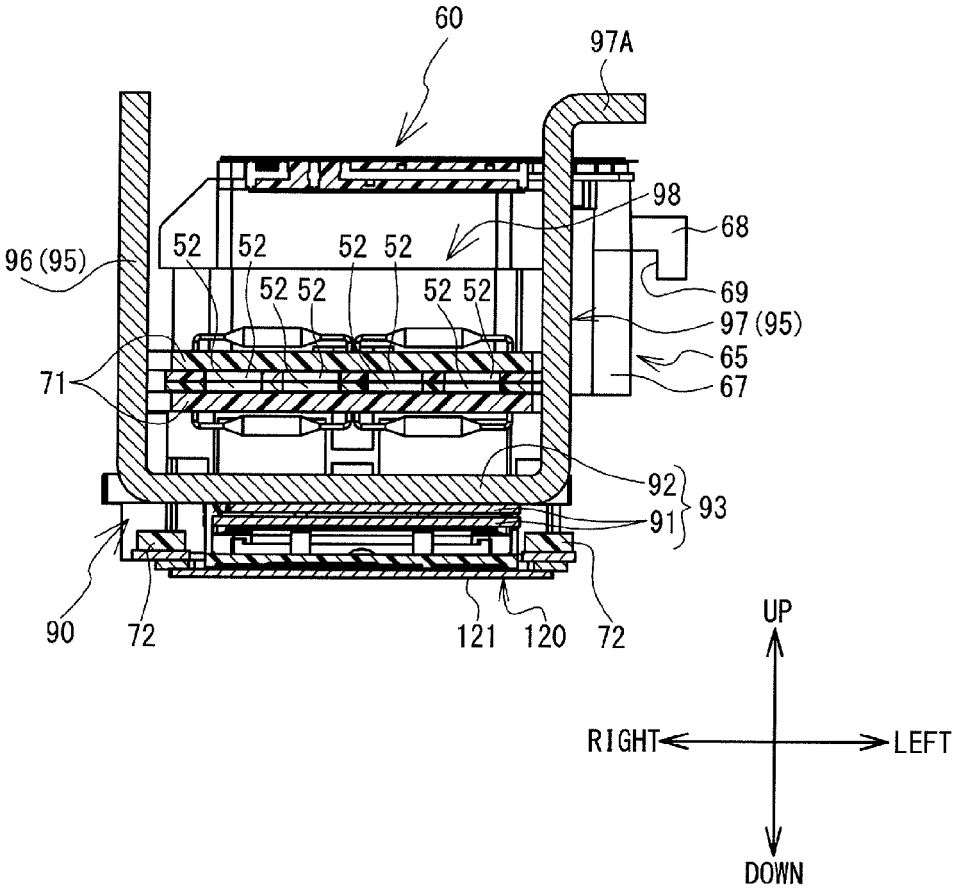
FIG. 6 is a cross-sectional view taken in the direction of arrows along a line C-C shown in FIG. 4.

As shown in FIGS. 5 and 6, the heat dissipation portion 90 is provided on the second direction side with respect to the boards 80. The heat dissipation portion 90 is formed by a metal material. The heat dissipation portion 90 includes a flat plate portion 93 and a pair of wall portions 95. The flat plate portion 93 is separated from the first heating portion 71 in the first direction. The flat plate portion 93 includes a first flat plate portion 91 and a second flat plate portion 92. The first flat plate portion 91 is a flat plate-shaped member that extends, in a state of being doubled over, substantially in parallel with the ejection surface 121. The lower surface of the first flat plate portion 91 is in contact with the two driving ICs 81. Since the first flat plate portion 91 is separated from the second heating portion 72 in the second direction, a space 88 is formed between the first flat plate portion 91 and the second heating portion 72.

The second flat plate portion 92 is a flat plate-shaped member that is substantially in parallel with the ejection surface 121. The second flat plate portion 92 is in contact with the upper surface of the first flat plate portion 91. The pair of wall portions 95 are wall portions that extend upward from both the left and right end portions of the second flat plate portion 92. The upper end portions of the pair of wall portions 95 extend further to the second direction side than the buffer tank 60. The pair of wall portions 95 are respectively provided on the left side and the right side with respect to the first heating portion 71 and the folded flow path portion 52, such that the pair of wall portions 95 are separated from each other. More specifically, the pair of wall portions 95 are provided side by side in a direction (the left-right direction) that is orthogonal to the extending direction of the first heating portion 71 and the folded flow path portion 52 and the first direction. One of the pair of wall portions 95 includes a right wall portion 96 and the other of the pair of wall portions 95 includes a left wall portion 97. The right wall portion 96 is provided on the right end portion of the second flat plate portion 92. The left wall portion 97 is provided on the left end portion of the second flat plate portion 92. An upper end portion 97A of the left wall portion 97 is bent to the left.

The first heating portion 71 and the folded flow path portion 52 are provided in a space 98, which is formed by the second flat plate portion 92 and the pair of wall portions 95. The space 98 is positioned at the rear side of the vertical flow path portion 51. That is, the space 98 is also divided by the vertical flow path portion 51.

Figure 7:
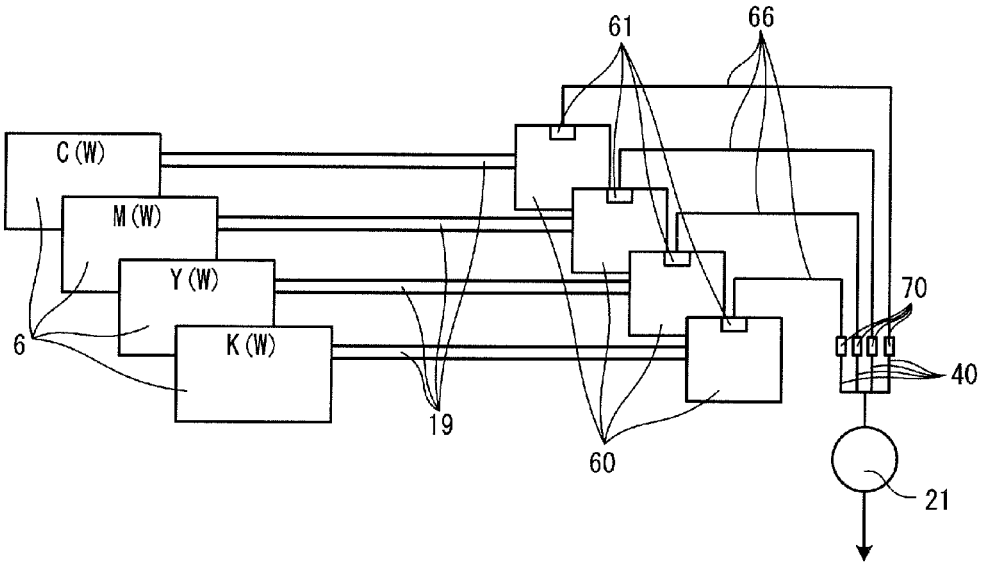
FIG. 7 is a schematic diagram showing paths from main tanks to a suction pump.

The discharge portion 65 will be explained in detail with reference to FIGS. 7 and 8. The above-described maintenance mechanism 20 is a mechanism that is configured to perform a suction purge of the head portion 120 and an exhaust purge. The suction purge is performed to maintain the head portion 120. The suction purge is an operation that forcibly discharges, by suction, ink containing foreign matter, bubbles, etc. from the head portion 120. The exhaust purge is performed to discharge air bubbles accumulated in the buffer tank 60 without going through the head portion 120. The exhaust purge is an operation that discharges ink containing bubbles etc. from an ink flow path that is located on the upstream side of the head portion 120.

An outline of the exhaust purge will be explained. As schematically shown in FIG. 7, the main tanks 6 of the respective color inks may supply the inks via the ink tubes 19 to the buffer tank 60. The four discharge flow path portions 66 connect the first flow portions 61 of the buffer tank 60 and the discharge pipes 40. The discharge pipes 40 are hollow flow path portions, and penetrate the third housing 33 in the up-down direction in the left end portion of the third housing 33. The four discharge pipes 40 are provided side by side in the front-rear direction. The discharge pipes 40 are connected to the outside of the head units 100 and 200 without going through the head portion 120. The exhaust purge is an operation to discharge the inks that are contained between the respective ink tubes 19 and the buffer tank 60 together with the accumulated bubbles via the four discharge flow path portions 66 and the discharge nozzles 70 from the discharge pipes 40 and to fill the buffer tank 60 with the inks. The maintenance mechanism 20 is provided below the right end of each of the guide rails 3. The maintenance mechanism 20 includes a suction pump 21.

The main tanks 6 for the respective color inks are connected to the leading end portions of the ink tubes 19. For example, when the inks are initially introduced, the maintenance mechanism 20 may drive the suction pump 21 to perform the exhaust purge. More specifically, the maintenance mechanism 20 may drive the suction pump 21, may discharge the inks contained up to the buffer tank 60, from the discharge pipes 40 via the four discharge flow path portions 66, which are respectively connected to the first flow portions 61, and may fill the buffer tank 60 with the inks. In the buffer tank 60, there are cases in which air bubbles from the outside enter into the inks due to air etc. that has passed through the ink tubes 19 etc. Therefore, the inks supplied from the main tanks 6 via the ink tubes 19 may be temporarily stored in the buffer tank 60, and thus the bubbles may separate and float up from the inks. The bubbles that have separated and floated up may be accumulated in an upper portion of the buffer tank 60. The suction pump 21 of the maintenance mechanism 20 may be driven and the exhaust purge may be performed. Thus, the accumulated air bubbles may be regularly discharged from the buffer tank 60, together with the inks in the buffer tank 60. The frequency of the exhaust purge may be changed as appropriate in accordance with the frequency of use, the usage environment, etc. of the printer 1.

As described above, the first flow portions 61, which are connected to the four discharge flow path portions 66, are provided in the left end portion of the buffer tank 60. The interior of the buffer tank 60 is divided into four spaces by flexible films. Each of the first flow path portions 61 is provided in each of the four spaces in the buffer tank 60. The first flow path portions 61 are respectively connected to the four discharge flow path portions 66, at the upper end of the discharge portion 65. The lower ends of the four discharge flow path portions 66 are respectively connected to the discharge nozzles 70. In a state in which the discharge nozzles 70 are connected to the discharge pipes 40 of the third housing 33, the discharge nozzles 70 are fixed to the third housing 33 by ultrasonic welding. The discharge portion 65 connects the buffer tank 60 and the discharge pipes 40, and is configured to discharge the ink containing the bubbles in the buffer tank 60 to the outside of the head units 100 and 200 via the discharge pipes 40.

In addition to the role as the flow paths of the inks and bubbles in the exhaust purge, the discharge portion 65 also has a role of supporting the buffer tank 60 horizontally. The upper end of the discharge portion 65 connects to the left end portion of the buffer tank 60 from below. The lower end of the discharge portion 65 is connected to the discharge pipes 40 of the third housing 33 via the discharge nozzles 70. In other words, the left end portion of the buffer tank 60 is supported by the discharge portion 65 that extends in the up-down direction, and is fixed to the third housing 33. That is, the discharge portion 65 supports the buffer tank 60 from below, and holds the buffer tank 60 in parallel with the ejection surface 121 of the head portion 120.

Figure 8:
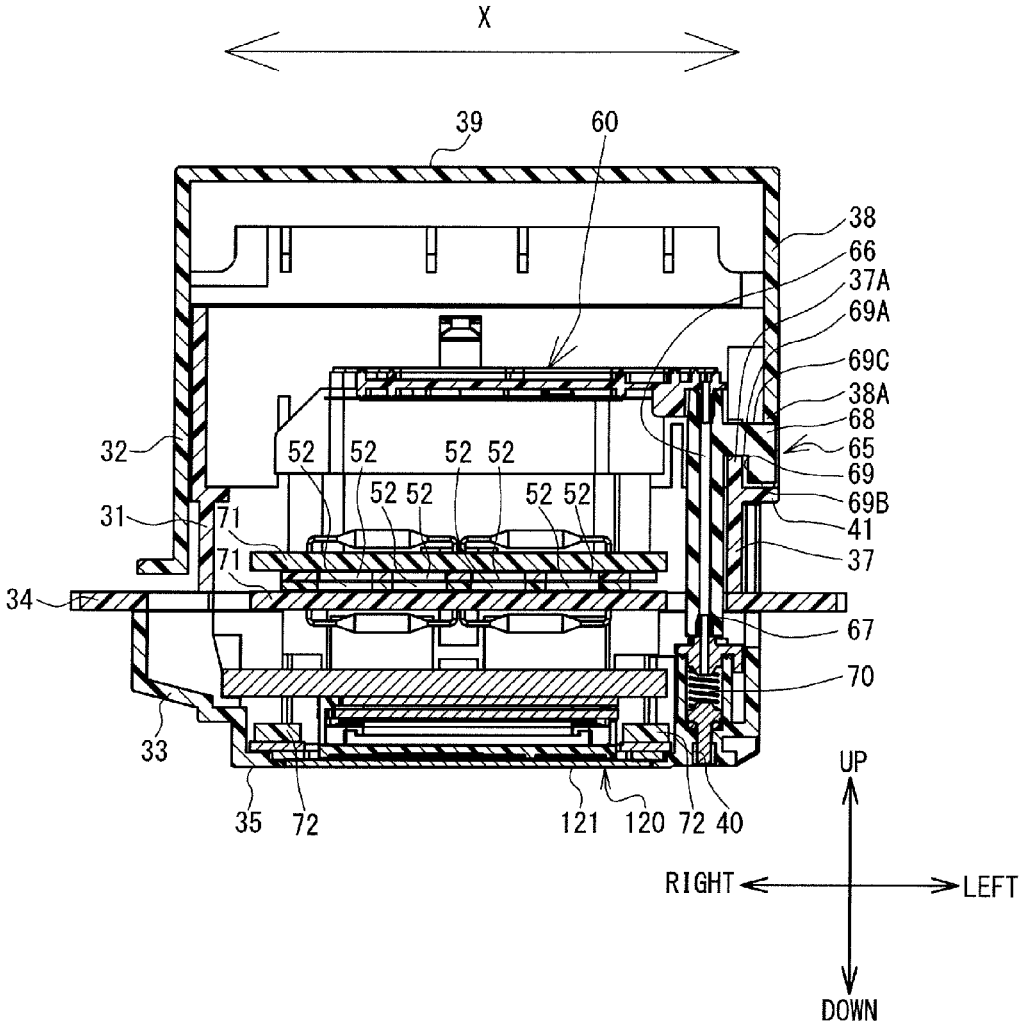
FIG. 8 is a cross-sectional view taken in the direction of arrows along a line A-A shown in FIG. 2.

As shown in FIG. 8, in the present embodiment, the folded flow path portion 52 and the first heating portion 71 are disposed, in the up-down direction, between the buffer tank 60 and the discharge pipes 40 of the third housing 33. In the present embodiment, the supply flow path portion 50 includes the folded flow path portion 52, taking into consideration the securing of the capacity of the supply flow path portion 50 to heat the inks and the suppression of the length of the folded flow path portion 52 in the front-rear direction. Meanwhile, the driving ICs 81 are disposed on a peripheral portion of the head portion 120 (refer to FIG. 5). The folded flow path portion 52 and the first heating portion 71 are disposed substantially in parallel with the ejection surface 121 of the head portion 120 in a state in which the folded flow path portion 52 is connected to the connection flow path portion 53.

In comparison to a case in which the supply flow path portion 50 does not include the folded flow path portion 52, in a case where the supply flow path portion 50 include the folded flow path portion 52, the length in the up-down direction of the supply flow path portion 50 due to the vertical flow path portion 51 and the connection flow path portion 53 becomes longer. In accordance with the distance in the up-down direction between the buffer tank 60 and the discharge pipes 40, the length in the up-down direction of the discharge portion 65, which connects the lower side of the left end portion of the buffer tank 60 and the discharge pipes 40 of the third housing 33, is determined. Therefore, the longer the distance in the up-down direction between the buffer tank 60 and the discharge pipes 40, the longer the length in the up-down direction of the discharge portion 65, which connects the first flow path portions 61 of the buffer tank 60 and the discharge pipes 40.

The discharge portion 65 may be made of an elastic member. In the present embodiment, the discharge portion 65 is made of rubber, which is an elastic member. The inks are filled in the buffer tank 60, which is supported by the upper side of the discharge portion 65. Therefore, as the length in the up-down direction of the discharge portion 65 becomes longer, the discharge portion 65 that supports the weight of the buffer tank 60) may be more likely to be deformed. Further, as the length in the up-down direction of the discharge portion 65 becomes longer, the discharge portion 65 may be more likely to be deformed due to the weight of the discharge portion 65 itself. Space inside the head units 100 and 200 is limited. In order to downsize the head units 100 and 200, it is necessary to hold the buffer tank 60 horizontally.

In the present embodiment, in order to support the buffer tank 60 in parallel to the ejection surface 121 by the discharge portion 65, which may be likely to be elastically deformed, the discharge portion 65 includes the engagement portion 68 to fix the discharge portion 65 to the housing 30. A stress may be applied to the discharge portion 65 due to the weight of the buffer tank 60 and acceleration when the head units 100 and 200 are moved reciprocatingly in the left-right direction (the feed direction) along the pair of the guide rails 3 when the printer 1 performs printing. In a case where the stress is applied to the discharge portion 65, deformation may occur in the discharge portion 65 due to strain. The elastic deformation of the discharge portion 65 may occur when the shape of the discharge portion 65 is restored from the deformation due to the strain. The discharge portion 65 is fixed to the housing 30 by the engagement portion 68. Thus, it is possible to suppress the strain due to the weight of the buffer tank 60 and due to the acceleration that is applied when the head units 100 and 200 are fed. It is possible to suppress the elastic deformation of the discharge portion 65 by suppressing the strain of the discharge portion 65.

The structure in which the discharge portion 65 is fixed to the housing 30 by the engagement portion 68 will be explained with reference to FIG. 8. As described above, the engagement portion 68 of the discharge portion 65 is provided with the recessed portion 69. On the left side of the discharge portion 65, the first side wall portion 37 of the first housing 31 extends from the support base 34 to a position where an upper end portion 37A of the first side wall portion 37 reaches an upper end portion 69A of the inner side of the recessed portion 69. The main body portion 67 of the discharge portion 65 is disposed such that the left side surface of the main body portion 67 on the engagement portion 68 side is positioned along the right side surface of the first side wall portion 37. The upper end portion 37A of the first side wall portion 37 and the upper end portion 69A of the inner side of the recessed portion 69 of the engagement portion 68 are disposed to face each other, and the upper end portion 37A of the first side wall portion 37 is fitted into the recessed portion 69 of the engagement portion 68. In other words, the engagement portion 68 covers the upper end portion 37A of the first side wall portion 37 from above and is hooked on the left side surface of the first side wall portion 37, thus fixing the discharge portion 65 to the first side wall portion 37. In this manner, even if the acceleration is applied in the left-right direction when the head units 100 and 200 are conveyed, it is possible to maintain the state in which the main body portion 67 of the discharge portion 65 is positioned along the right side surface of the first side wall portion 37. It is therefore possible to suppress the discharge portion 65 from swinging due to the feeding of the head units 100 and 200, and it is possible to suppress the discharge portion 65 from being elastically deformed.

The first side wall portion 37 is provided with a receiving portion 41. The receiving portion 41 is a plate-shaped member that is provided substantially perpendicular to the left side surface of the first side wall portion 37 such that the receiving portion 41 extends to the left from the left side surface of the first side wall portion 37. The length in the up-down direction from the top surface of the receiving portion 41 to the upper end portion 37A of the first side wall portion 37 is substantially the same as the length in the up-down direction from the upper end portion 69A of the recessed portion 69 of the engagement portion 68 to a lower end portion 69B of the engagement portion 68. The length in the up-down direction of the engagement portion 68 is a length that makes it possible to maintain the state in which the engagement portion 68 is hooked on the left side surface of the first side wall portion 37 when the acceleration in the left-right direction is applied to the discharge portion 65 by the feeding of the head units 100 and 200. The receiving portion 41 can support the lower end portion 69B of the engagement portion 68 from below in a state in which the upper end portion 37A of the first side wall portion 37 is fitted into the recessed portion 69 of the engagement portion 68.

In a state in which the first housing 31, the second housing 32, the third housing 33 and the support base 34 are combined to form the housing 30 as a unit, a lower end portion 38A of the second side wall portion 38 of the second housing 32 extends to an upper end portion 69C on the outer side of the engagement portion 68 of the discharge portion 65. Thus, the upper end portion 69C on the outer side of the engagement portion 68 of the discharge portion 65 is pressed, from above, by the lower end portion 38A of the second side wall portion 38 of the second housing 32, while the lower end portion 69B of the engagement portion 68 is supported by the receiving portion 41 from below. In other words, the outer side and the inner side of the recessed portion 69 of the engagement portion 68 of the discharge portion 65 are clamped in the up-down direction between the lower end portion 38A of the second side wall portion 38 of the second housing 32 and the receiving portion 41 of the first side wall portion 37 of the first housing 31. As a result, the discharge portion 65 may be reliably fixed to the housing 30, and it is possible to suppress the strain of the discharge portion 65 that may cause elastic deformation of the discharge portion 65.

As described above, the discharge portion 65 that is fixed to the housing 30 is positioned on the left end portion side of the buffer tank 60 in a state in which the head units 100 and 200 are installed in the printer 1. When the printer 1 performs printing, the acceleration in the left-right direction, which is the feed direction of the head units 100 and 200, may be easily applied to the head units 100 and 200. In this case, the acceleration in the left-right direction may also be applied to the buffer tank 60 that is supported by the housing 30. Therefore, the buffer tank 60 may swing in the left-right direction. The discharge portion 65 is fixed to the housing 30, on the left end portion side that is one of the left and right directions, in which the buffer tank 60 is likely to swing, thus supporting the buffer tank 60. Therefore, when the head units 100 and 200 are fed, it is possible to effectively support the buffer tank 60 horizontally.

As explained above, in the printer 1 and the head units 100 and 200 of the present embodiment, the discharge portion 65 connects the buffer tank 60 and the discharge pipes 40 of the third housing 33. The engagement portion 68 of the discharge portion 65 fixes the discharge portion 65 to the first housing 31 such that the engagement portion 68 is hooked on the upper end portion 37A of the first side wall portion 37. Therefore, the discharge portion 65 can support the buffer tank 60 such that the buffer tank 60 is parallel to the ejection surface 121, on which the plurality of ejection ports 125 are arrayed.

The discharge portion 65 is fixed to the housing 30 such that the engagement portion 68 covers, from above, the upper end portion 37A of the first side wall portion 37 of the first housing 31. The engagement portion 68 is pressed, from above, by the lower end portion 38A of the second side wall portion 38 of the second housing 32. The engagement portion 68 is clamped between the second side wall portion 38 and the first side wall portion 37 in the up-down direction. Therefore, the discharge portion 65 may be more reliably fixed to the housing 30. Thus, in the printer 1 and the head units 100 and 200, the discharge portion 65 can more reliably support the buffer tank 60.

The discharge portion 65 is clamped between the first side wall portion 37 and the second side wall portion 38, on the inner side and the outer side of the recessed portion 69 of the engagement portion 68. Therefore, the discharge portion 65 may be reliably fixed to the housing 30.

When the head units 100 and 200 are fed, a load in the left-right direction, which is the feed direction, may be likely to be applied to the buffer tank 60. The buffer tank 60 is supported by the discharge portion 65, on the left end portion side that is one end portion side in the feed direction. Therefore, even when the head units 100 and 200 are being conveyed, the discharge portion 65 can reliably support the buffer tank 60.

In the printer 1 and the head units 100 and 200, the first heating portion 71 and the folded flow path portion 52 are disposed, in the up-down direction, between the buffer tank 60 and the discharge pipes 40. As a result, there is a possibility of an increase in the distance between the buffer tank 60 and the discharge pipes 40. However, the discharge portion 65 can reliably support the buffer tank 60.

Hereinafter, modifications that can be made to the above-described embodiment will be exemplified. For example, the printer 1 need not necessarily include the two head units 100 and 200. For example, the printer 1 may include the single head unit 100 only. The number of sections into which the inside of the head portion 120 is divided may be changed to a number other than four. For example, each of the head units 100 and 200 need not necessarily include at least one or all of the first heating portion 71, the second heating portion 72, and the folded flow path portion 52.

The liquid that is supplied to the head portion 120 is not limited to the above-exemplified inks. For example, the liquid that is supplied to the head portion 120 may be another color of ink. For example, a treating agent to improve ink fixing may be used instead of the pre-treatment ink, and a color ink may be used as a post-treatment liquid. For example, in discharge printing, a discharging agent may be used instead of the pre-treatment ink, and a discharging ink may be used as the post-treatment ink. In other words, it is sufficient that the liquid that can be ejected from the head portion 120 is a liquid having characteristics, such as viscosity etc., that allow ejection from the head portion 120. Therefore, the liquid is not limited to ink, and may be a chemical agent, such as a decoloring agent, for example. The pre-treatment liquid and the post-treatment liquid may be the same type of liquid.

The shape, the material, the number and the arrangement of the discharge portion 65 can be changed as appropriate. For example, the shape of the discharge portion 65 may be a shape in which columnns are arranged side by side in the left-right direction. The material of the discharge portion 65 may be synthetic resin or the like. The discharge portion 65 may support the buffer tank 60 on the right end portion side, which is one end portion side in the left-right direction, which is the feed direction of the head units 100 and 200. When the head units 100 and 200 are fed, the buffer tank 60 may be swing in the left-right direction. Also in this type of case, the discharge portion 65 can effectively support the buffer tank 60 horizontally.

In the above-described embodiment, the inner side and the outer side of the recessed portion 69 of the engagement portion 68 of the discharge portion 65 are clamped in the up-down direction between the receiving portion 41 of the first side wall portion 37 and the lower end portion 38A of the second side wall portion 38. The direction in which the inner side and the outer side of the recessed portion 69 are clamped is not limited to the up-down direction. For example, the second side wall portion 38 may be provided to extend along the left side surface of the engagement portion 68 of the discharge portion 65. Then, the discharge portion 65 may be fixed to the housing 30 by clamping the inner side and the outer side of the recessed portion 69 of the engagement portion 68 in the left-right direction between the first side wall portion 37 and the second side wall portion 38.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

an ejection portion that includes an ejection surface, the ejection surface including a plurality of ejection ports arrayed along a direction intersecting an ejection direction, the plurality of ejection ports being configured to eject liquid in the ejection direction;

a liquid supply portion that is configured to supply the ejection portion with the liquid supplied from a storage portion, the storage portion being configured to store the liquid, and the liquid supply portion extending in parallel with the ejection surface;

a support member that is substantially box-shaped and that includes a bottom wall portion and a side wall portion, the side wall portion extending from a periphery of the bottom wall portion, and the support member supporting the ejection portion by fixing the ejection surface to the bottom wall portion;

a discharge portion that is provided on the support member, the discharge portion being connected to an outside of the support member without going through the ejection portion;

a first flow path portion that includes a hollow portion, the first flow path portion connecting the liquid supply portion and the discharge portion, and the first flow path portion being configured to support the liquid supply portion from below; and an engagement portion that includes a recessed portion, the engagement portion being configured to fix the first flow path portion to the support member by engaging with the side wall portion of the support member.

2. The printer according to claim 1, wherein the support member includes a first support member and a second support member, the first support member being configured to support the ejection portion from a side of the ejection surface, and the second support member being configured to cover the liquid supply portion from an opposite side to the side of the ejection surface, the side wall portion includes a first side wall portion and a second side wall portion, the first support member including the first side wall portion, and the second support member including the second side wall portion, the engagement portion includes a first section and a second section, the first section being disposed along the first side wall portion, and the second section being clamped between the first side wall portion and the second side wall portion.

3. The printer according to claim 2, wherein an upper end portion of the first side wall portion is disposed on an inner side of the recessed portion, and a lower end portion of the second side wall portion is disposed on an outer side of the recessed portion.

4. The printer according to claim 1, further comprising:

a feed portion that is configured to feed the support member in a feed direction, the feed direction being parallel to the ejection surface, wherein the first flow path portion is disposed on one end side, in the feed direction, of the liquid supply portion.

5. The printer according to claim 1, wherein the first flow path portion and the engagement portion are each made of an elastic member.

6. A print head unit comprising:

an ejection portion that includes an ejection surface, the ejection surface including a plurality of ejection ports arrayed along a direction intersecting an ejection direction, the plurality of ejection ports being configured to eject liquid in the ejection direction;

a liquid supply portion that is configured to supply the ejection portion with the liquid, the liquid supply portion extending in parallel with the ejection surface;

a support member that is substantially box-shaped and that includes a bottom wall portion and a side wall portion, the side wall portion extending from a periphery of the bottom wall portion, and the support member supporting the ejection portion by fixing the ejection surface to the bottom wall portion;

a discharge portion that is provided on the support member, the discharge portion being connected to an outside of the support member without going through the ejection portion;

a first flow path portion that includes a hollow portion, the first flow path portion connecting the liquid supply portion and the discharge portion, and the first flow path portion being configured to support the liquid supply portion from below; and an engagement portion that includes a recessed portion, the engagement portion being configured to fix the first flow path portion to the support member by engaging with the side wall portion of the support member.

7. The print head unit according to claim 6, wherein the support member includes a first support member and a second support member, the first support member being configured to support the ejection portion from a side of the ejection surface, and the second support member being configured to cover the liquid supply portion from an opposite side to the side of the ejection surface, the side wall portion includes a first side wall portion and a second side wall portion, the first support member including the first side wall portion, and the second support member including the second side wall portion, the engagement portion includes a first section and a second section, the first section being disposed along the first side wall portion, and the second section being clamped between the first side wall portion and the second side wall portion.

8. The print head unit according to claim 7, wherein an upper end portion of the first side wall portion is disposed on an inner side of the recessed portion, and a lower end portion of the second side wall portion is disposed on an outer side of the recessed portion.

9. The print head unit according to claim 6, wherein the first flow path portion and the engagement portion are each made of an elastic member.

* * * * *